United States Patent [19]

Sasaki et al.

[11] Patent Number: 4,848,033

[45] Date of Patent: Jul. 18, 1989

[54] WINDOW REGULATOR

[75] Inventors: Minoru Sasaki; Nobuji Suzuki, both of Tokyo, Japan

[73] Assignee: Fuji Jukogyo Kabushiki Kaisha, Tokyo, Japan

[21] Appl. No.: 287,870

[22] Filed: Dec. 19, 1988

[30] Foreign Application Priority Data

Dec. 23, 1987 [JP] Japan ..... 62-196419

[51] Int. Cl.[4] ..... E05F 11/48

[52] U.S. Cl. ..... 49/352

[58] Field of Search ..... 49/352, 348, 349, 227, 49/374

[56] References Cited

U.S. PATENT DOCUMENTS 4,648,206 3/1987 Moriya et al. ..... 49/352

4,658,546 4/1987 Moriya et al. ..... 49/352

FOREIGN PATENT DOCUMENTS 60-19896 of 0000 Japan .

*Primary Examiner*—Philip C. Kannan

*Attorney, Agent, or Firm*—Martin A. Farber

[57] ABSTRACT

A window regulator device has an endless wire connected to a glass and a regulator handle and disposed in a space between an outer panel of a door and a glass receiving space formed in the door. A part of the wire is extended into a space between an inner panel and the glass receiving space over a sash and engaged with the handle operating member, so that the glass is raised by the handle.

3 Claims, 4 Drawing Sheets

WINDOW REGULATOR

BACKGROUND OF THE INVENTION

The present relates to a window regulator for raising and lowering a window of a door of a motor vehicle.

Japanese Utility Model Publication 60-19896 discloses window regulator disposed between an inner panel of a door of a vehicle and a space for receiving a door glass, since a regulator handle for operating the regulator is provided on the inner panel. Accordingly, in order to provide such a space for the regulator, the inner door panel bulges into the interior space of the vehicle.

Moreover, a door trim pocket provided on the inner panel takes up the interior space, so that a leg room is decreased. Thus, interior space becomes confined, making passengers feel oppressed and uncomfortable while travelling on the vehicle.

SUMMARY OF THE INVENTION

The object of the present invention is to provide a window regulator, whereby a sufficient interior space of the vehicle can be provided to ensure a comfortable travel on the vehicle.

According to the present invention, there is provided a window regulator for a door of a motor vehicle, the door having an outer panel, an inner panel, a glass receiving space provided between the outer and inner panels for receiving a glass, a window regulator device provided between the outer and inner panels, an operating member operatively connected to the window regulator device so as to raise and lower the glass.

The window regulator device comprises an endless wire connected to the glass and the operating member and disposed in a space between the outer panel and the glass receiving space. A part of the wire is extended into a space between the inner panel and the glass receiving space over a sash and engaged with the operating member, so that the glass is raised and lowered by the operation of the operating member.

In an aspect of the invention, the operating member is a regulator handle, and the wire is wound on a drum of the regulator handle.

The other objects and features of this invention will become understood from the following description with reference to the accompanying drawings.

DETAILED DESCRIPTION OF THE PREFERRED EMBODIMENT

Figure 1:
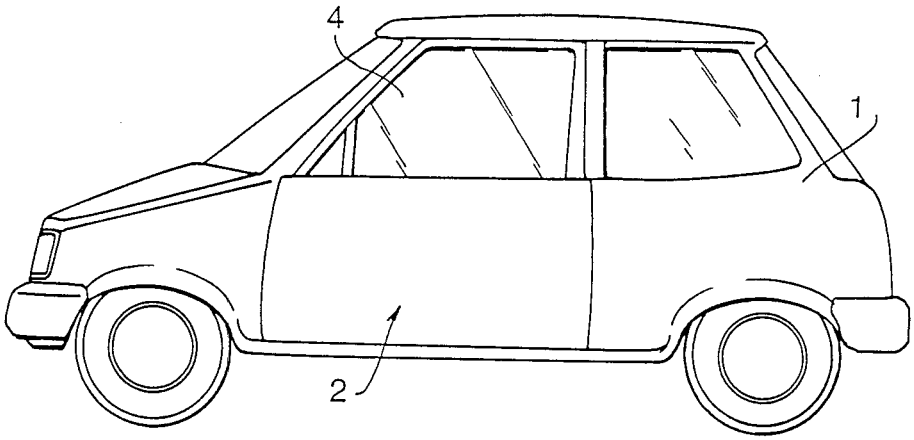
FIG. 1 a schematic illustration of a two-door motor vehicle.
Figure 3:
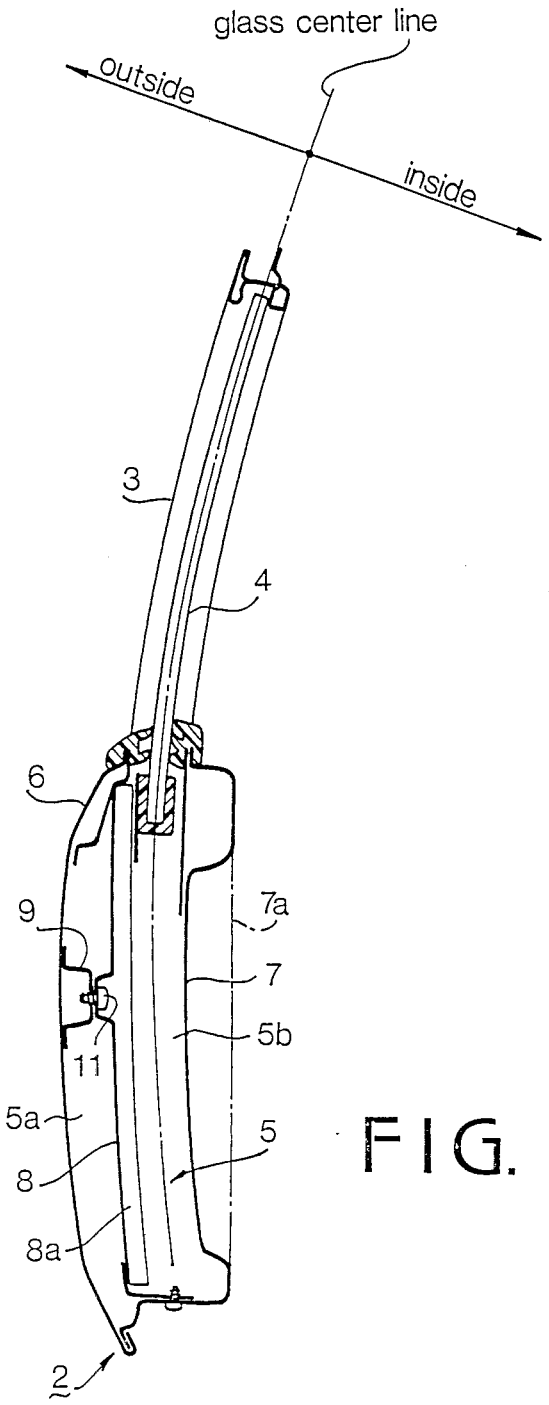
FIG. 3 is a sectional view of the door.

Referring to FIGS. 1 and 3, each door 2 mounted on a body 1 of a two-door vehicle comprises a door sash 3, an outer panel 6 and an inner panel 7. A door glass 4 is mounted in the door 2 so as to slide along the door sash 3 and to be put in a glass receiving space 5 defined by the two panels 6 and 7, when lowered. A regulator device 8 for raising and lowering the glass 4 is disposed in an outer space 5*a* of the receiving space 5 between the glass 4 and the outer panel.

Figure 2:
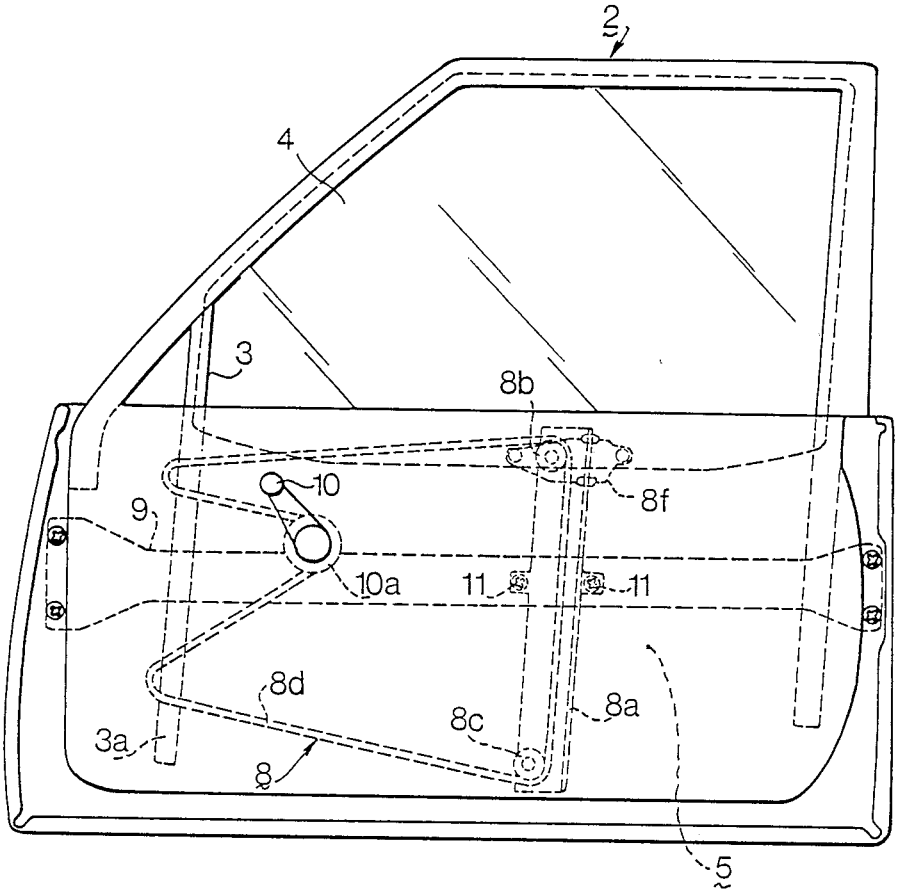
FIG. 2 is an elevational view of a door of the vehicle of FIG. 1.

As shown in FIG. 2, the regulator device 8 comprises a vertical guide plate 8*a* having a pair of lobes 11 at which the guide plate 8*a* is fixed to a longitudinal reinforcement member 9 securely mounted on the inner side of the outer panel 6. The regulator device 8 further comprises pulleys 8*b* and 8*c* disposed on upper and lower portions of the guide plate 8*a*, respectively, endless operating wire engaged with the pulleys 8*b*, 8*c*, and connecting member 8*f* for connecting the wire 8*d* with a lower edge of the glass 4.

Figure 5:
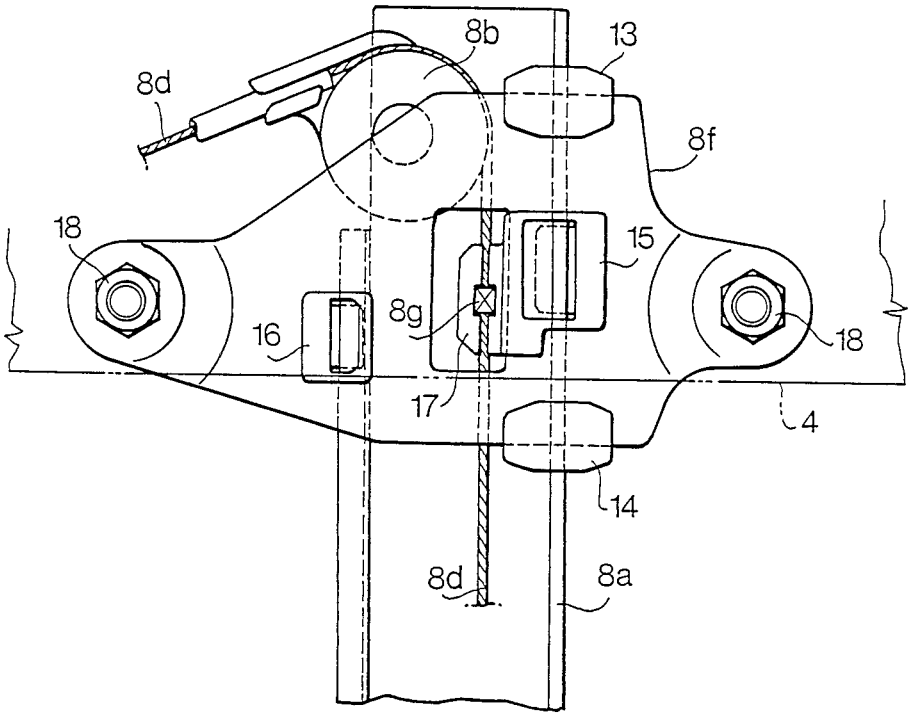
FIG. 5 is an enlarged elevational view showing a connecting member.
Figure 6:
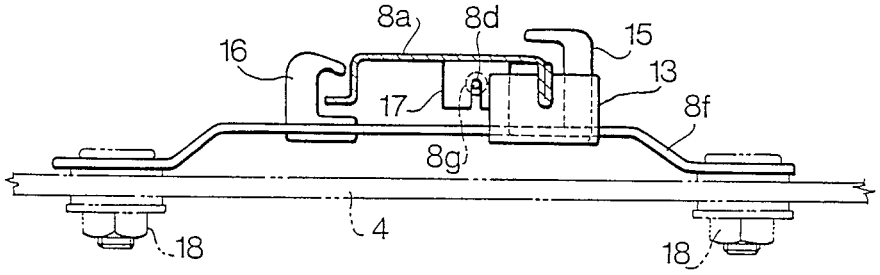
FIG. 6 is a plan view of the connecting member.

Referring to FIGS. 5 and 6, the connecting member 8*f* has upper and lower slides 13 and 14, right and left guide members 15 and 16, and a wire connector 17. The slides 13, 14 and guide members 15, 16 are slidably engaged with the guide plate 8*a*, for guiding the connecting member 8*f*. The wire 8*d* has a stopper 8*g* which is engaged with a hole of the wire connector 17, thereby connecting the wire with the connecting member 8*f*. The connecting member 8*f* is secured to the glass 4 by bolts 18.

Figure 4:
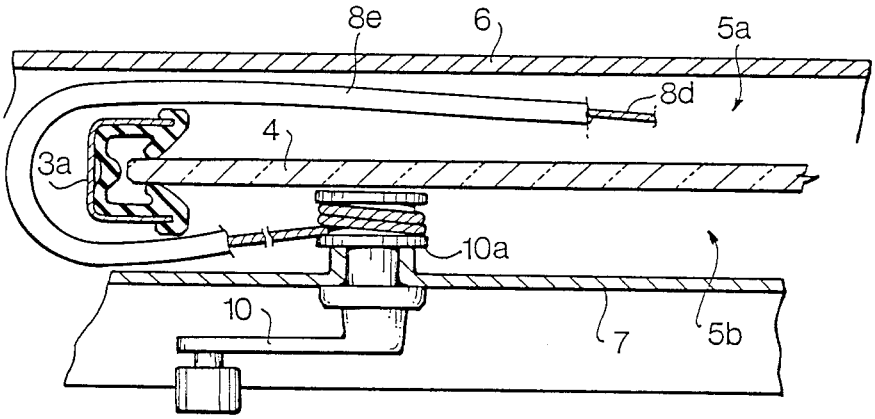
FIG. 4 is a sectional plan view of a part of the door.

As shown in FIG. 4, the wire 8*d* in a sheath 8*e* is lead around an upper part of a front portion 3*a* of the door sash (garnish) 3 to enter into an inner space 5*b* between the glass 4 and the inner panel 7. The wire 8*d* is wound on a drum 10*a* of a regulator handle 10 rotatably supported on the inner panel 7. The wire 8*d* is further arranged to go around the front portion 3*c* at a lower part, thereby returning to the outer space 5*a*.

When the regulator handle 10 is rotated, the wire 8*d* is moved in one direction so that the actuating member 8*a* is raised or lowered between the pulleys 8*b* and 8*c*. Hence, the door glass 4 is lifted so as to project out of the receiving space 5 or lowered to be inserted therein.

Since the regulator device 8 is disposed in the space 5*a* between the outer panel 6 and the glass 4 except for a small part of the wire 8*d* wound on the drum 10*a*, it is possible to minimize the space 5*b*. Therefore, the inner surface of the inner panel 7 according to the present invention can be caved in to a limit adjacent the inner surface of the glass 4, whereas in the conventional door, the surface of the panel is vertical as shown by a chain line 7*a* in FIG. 3. Accordingly, even if a door trim pocket is attached to the inner panel 7, the pocket does not largely take up the space in the vehicle. Thus, passengers do not feel oppressed and are able to travel comfortably.

In addition, since the space 5*b* is vacant, the space can be further utilized for receiving other things, for example, a wire harness can be easily disposed therein. Since the regulator device 8 is disposed along the outer panel 6, the rigidity thereof is improved.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A window regulator for a door of a motor vehicle, the door having an outer panel, an inner panel, a glass receiving space provided between the outer and inner panels for receiving a glass, a window regulator device provided between the outer and inner panels, an operating member operatively connected to the window regulator device so as to raise and lower the glass, the improvement comprising:

the window regulator device having an endless wire connected to the glass by a connecting member and engaged with the operating member, and disposed in a space between the outer panel and the glass receiving space, a part of the wire being extended into a space between the inner panel and the glass receiving space over a sash and engaged with the operating member, so that the glass is raised and lowered by the operation of the operating member.

2. The window regulator according to claim 1 wherein the operating member is a regulator handle.

3. The window regulator according to claim 2 wherein the wire is wound on a drum of the regulator handle.

* * * * *